US010704548B2

(12) United States Patent
Choi et al.

(10) Patent No.: US 10,704,548 B2
(45) Date of Patent: Jul. 7, 2020

(54) CO-ROTATING SCROLL COMPRESSOR HAVING BACK PRESSURE STRUCTURE

(71) Applicant: LG ELECTRONICS INC., Seoul (KR)

(72) Inventors: Yoonsung Choi, Seoul (KR); Byung-Kil Yoo, Seoul (KR); Jinho Kim, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 256 days.

(21) Appl. No.: 15/706,921

(22) Filed: Sep. 18, 2017

(65) Prior Publication Data

US 2018/0080446 A1 Mar. 22, 2018

(30) Foreign Application Priority Data

Sep. 20, 2016 (KR) ..... 10-2016-0119942

(51) Int. Cl.
*F04C 18/02* (2006.01)
*F04C 29/02* (2006.01)
*F04C 27/00* (2006.01)

(52) U.S. Cl.
CPC ..... *F04C 18/023* (2013.01); *F04C 18/0246* (2013.01); *F04C 29/02* (2013.01); (Continued)

(58) Field of Classification Search
CPC .. F04C 18/023; F04C 29/023; F04C 18/0246; F04C 27/008; F04C 2240/56; F04C 2240/603
See application file for complete search history.

(56) References Cited

U.S. PATENT DOCUMENTS 4,735,559 A * 4/1988 Morishita ..... F04C 27/02 418/100
4,768,936 A * 9/1988 Etemad ..... F04C 23/008 184/6.2

(Continued)

FOREIGN PATENT DOCUMENTS

JP 02227578 * 2/1989 ..... F01C 1/023
JP 02227578 * 9/1990 ..... F04C 18/02

(Continued)

OTHER PUBLICATIONS

JP02227578—translation (Year: 1989).*
International Search Report dated Dec. 21, 2017.

*Primary Examiner* — Patrick Hamo
*Assistant Examiner* — David N Brandt
(74) *Attorney, Agent, or Firm* — KED & Associates LLP

(57) ABSTRACT

A co-rotating scroll compressor is provided in which pressure differences between inner and outer portions of a suction chamber are maintained, back pressures are applied to rear surfaces of end plates of a drive scroll and a driven scroll in directions in which the two scrolls are moved toward each other to prevent compression leakage of a fluid, and a lubricant oil is easily supplied to the two scrolls using the back pressures. The co-rotating scroll compressor may include pressure seals between the rear surfaces of the end plates of the drive scroll and the driven scroll and an inner wall of the suction chamber such that the two scrolls are pressed in directions to be moved toward each other by the back pressures, and the oil is supplied to rotary supports and close contact portions of the two scrolls using the back pressures.

20 Claims, 5 Drawing Sheets

(52) U.S. Cl.
CPC ..... *F04C 29/028* (2013.01); *F04C 27/008* (2013.01); *F04C 2240/56* (2013.01); *F04C 2240/603* (2013.01)

(56) References Cited

U.S. PATENT DOCUMENTS

| | | | | | |
|---|---|---|---|---|---|
| 4,938,669 | A * | 7/1990 | Fraser, Jr. | F04C 18/0215 | 418/55.5 |
| 5,212,964 | A * | 5/1993 | Utter | F04C 18/023 | 418/55.6 |
| 5,449,279 | A * | 9/1995 | Hill | F04C 18/023 | 418/55.5 |
| 2013/0078131 | A1 * | 3/2013 | Ahn | F04C 23/008 | 418/55.4 |

FOREIGN PATENT DOCUMENTS

| | | |
|---|---|---|
| JP | 07-259763 | 10/1995 |
| JP | 09-158862 | 6/1997 |
| JP | 3066105 | 5/2000 |
| KR | 10-0724047 | 6/2007 |

* cited by examiner

CO-ROTATING SCROLL COMPRESSOR HAVING BACK PRESSURE STRUCTURE

CROSS-REFERENCE TO RELATED APPLICATION(S)

This application claims priority to and the benefit of Korean Patent Application No. 10-2016-0119942, filed in Korea on Sep. 20, 2016, the disclosure of which is incorporated herein by reference in its entirety.

BACKGROUND

1. Field

A co-rotating scroll compressor having a back pressure structure is disclosed herein.

2. Background

A scroll compressor is a compressor in which a fluid introduced therein is compressed toward a center of two scrolls which orbit relative to each other due to shapes of wraps of the two scrolls and discharged from the center of the scrolls in a compressed state. Each of the scrolls has a structure in which the wrap is formed in an end plate, and the scroll compressor is formed such that portions at which the wraps of the two scrolls are formed face each other, the wraps overlap, and side surfaces of the wraps are in contact with each other so as to provide a compression space.

The scroll compressor uses a pair of scrolls according to a principle of compression. One conventional compressor is an orbiting scroll compressor, in which one scroll is fixed and the other scroll does not rotate, but rather, orbits to compress a fluid. The orbiting scroll compressor has to operate such that the orbiting scroll orbits but does not rotate about the fixed scroll, and as a center of gravity of the orbiting scroll has to be eccentric from a center of orbiting in principle, there is a problem in that vibration increases due to a centrifugal force proportional to a square of a speed as a rotational speed increases. However, in a co-rotating scroll compressor, as a drive scroll and a driven scroll rotate in a same direction and rotary shafts only rotate about deviated rotational centers and do not orbit, there are no centrifugal problems due to the eccentric centers which may occur in the orbiting scroll compressor in principle.

When the wraps of two scrolls face and orbit relative to each other to compress a fluid, front end portions of the wraps of the two scrolls and front surfaces of the end plates facing the front end portions should be pressed against each other. When the front end portions of the wraps and the facing end plates of the scrolls are not pressed against each other, there is a problem in that a pressure of a compressed fluid leaks, and thus, compression efficiency decreases.

In the orbiting scroll compressor, as only the orbiting scroll rotates, in a state in which the fixed scroll does not rotate and is fixed to a frame of the compressor, when a pressure which pushes the orbiting scroll toward the fixed scroll is applied to the orbiting scroll, a front end portion of the wrap of the orbiting scroll is pressed against the end plated of the fixed scroll and the end plate of the orbiting scroll is also pressed against the front end portion of the wrap of the fixed scroll. However, in the co-rotating scroll compressor, as both the drive scroll and the driven scroll rotate, it is not easy to form a structure in which the two scrolls are pushed toward each other to be moved toward each other. A structure in which an extension portion is formed on the drive scroll, the extension portion of the drive scroll surrounds a rear surface of the driven scroll, and the driven scroll is supported by the extension portion and pushed toward the drive scroll is conventionally used. However, in such a conventional structure of a co-rotating scroll compressor, a structure of the drive scroll is complex, the extension portion of the drive scroll occupies a portion of a space of a suction chamber, and thus, there is a problem in that suction efficiency of the suction chamber decreases.

As described above, in the scroll compressor, as the two scrolls should orbit relative to each other in a state in which the surfaces of the end plates are pressed against the front end portions of the wraps and side surfaces of the wraps of two scrolls are pressed against each other, it is necessary to lubricate rotary support structures of the two scrolls and between the two scrolls. In the orbiting scroll compressor, as the fixed scroll does not rotate and only the orbiting scroll orbits, it is adequate for oil to be supplied to an eccentric shaft of the orbiting scroll configured to eccentrically orbit and to support portions of a drive rotary shaft for orbiting the orbiting scroll, and between the scrolls. More particularly, as the fixed scroll is fixed to the frame, it is not very difficult to lubricate a close contact portion between the two scrolls when the fixed scroll is located above the orbiting scroll and the oil is supplied toward the fixed scroll through a flow path of the frame.

However, in the co-rotating scroll compressor, as both the drive scroll and the driven scroll rotate, oil should be supplied to all portions configured to support the rotary shafts of the two scrolls. In addition, as both of the two scrolls rotate relative to the frame of the compressor, it is difficult to form a structure configured to supply the oil between the two scrolls, and thus, there is a problem in that the structure becomes complex.

BRIEF DESCRIPTION OF THE DRAWINGS

Embodiments will be described in detail with reference to the following drawings in which like reference numerals refer to like elements, and wherein.

DETAILED DESCRIPTION

Figure 1:
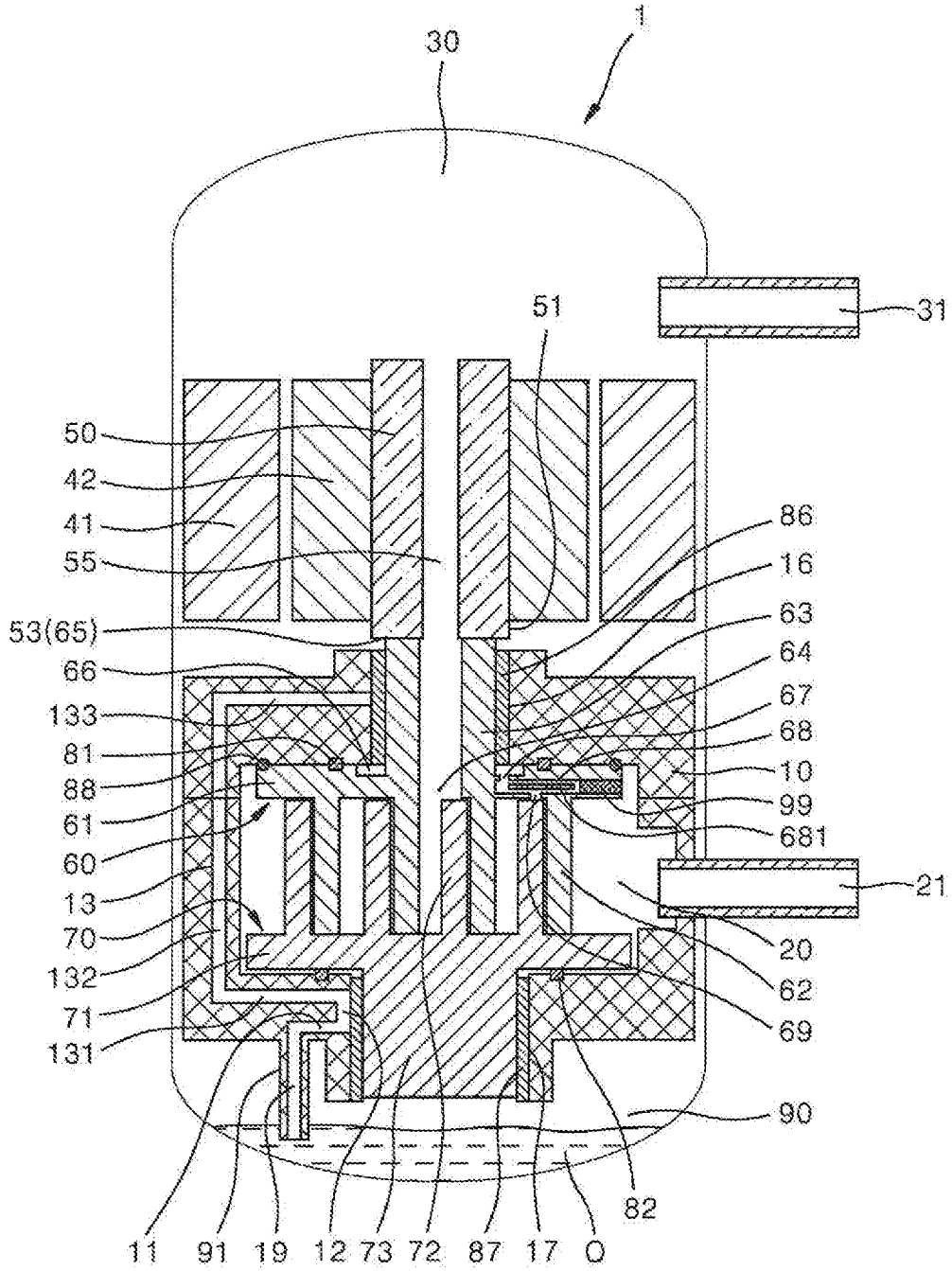
FIG. 1 is a schematic cross-sectional view of a co-rotating scroll compressor according to an embodiment.

Hereinafter, embodiments will be described with reference to the accompanying drawings. Wherever possible, like or similar reference numerals have been used to indicate like or similar elements, and repetitive disclosure has been omitted. Embodiments are not limited to the embodiments described below and may be made in various different forms, the embodiments are provided such that embodiments are completely disclosed, and a scope is completely understood by those skilled in the art.

FIG. 1 is a schematic cross-sectional view of a co-rotating scroll compressor according to an embodiment. A co-rotating scroll compressor 1 according to an embodiment may include a frame 10 forming an overall exterior thereof, configured to accommodate drive sources 41, 42, and 50 and co-rotating scrolls 60 and 70 thereinside, and configured to divide inner and outer spaces of the compressor. The frame 10 may be assembled through a method, for example, in which a plurality of components is separately manufactured and directly or indirectly fixed to each other for the sake of convenience in manufacture and assembly.

A suction chamber 20 is formed in a predetermined region of the frame 10, and a suction port 21, which is a path through which a fluid may be introduced, may be installed in the suction chamber 20 to communicate with an inner space of the suction chamber. The first scroll 60 and the second scroll 70 configured to rotate about corresponding rotary shafts thereof may be provided in the suction chamber 20. A first scroll 60, which may be located in or at an upper portion of the suction chamber 20, may be a drive scroll configured to receive a rotational force from a drive source, and a second scroll 70, which may be located in a lower portion of the suction chamber 20, may be a driven scroll configured to receive the rotational force from the first scroll 60 to rotate relative to the first scroll 60.

The first scroll 60 may include an end plate 61 in a substantially circular plate shape, and a wrap 62 in a spiral shape that protrudes from a (lower) surface of the end plate 61, that is, from a surface facing the second scroll 70, toward the second scroll 70. A boss 63 may protrude from a center of a (an upper) surface of the end plate 61, that is, from a surface opposite to the surface facing the second scroll 70. The boss 63 may be formed in a substantially cylindrical shape, be accommodated in a first shaft hole 16 formed in the frame 10 and located above the suction chamber 20, and be rotatably supported by a first bearing 86.

The second scroll 70 may include an end plate 71 in a substantially circular plate shape, and a wrap 72 in a spiral shape that protrudes from a (an upper) surface of the end plate 71, that is, from a surface facing the first scroll 60, toward the first scroll 60. A boss 73 may protrude from a center of a (lower) surface of the end plate 71, that is, from a surface opposite to the surface facing the first scroll 60. The boss 73 may be formed in a substantially cylindrical shape, be accommodated in a second shaft hole 17 formed in frame 10 and located under the suction chamber 20, and be rotatably supported by a second bearing 87.

A central rotational shaft of the first scroll 60 may be aligned with a geometrical axis of the boss 63, and a central rotational shaft of the second scroll 70 may be aligned with a geometrical axis of the boss 73. That is, the first scroll 60 and the second scroll 70 may respectively rotate about centers of the end plates 61 and 71 without eccentricity, and such rotations may be supported by the bosses 63 and 73 and the bearings 86 and 87. However, as the boss 63, the first shaft hole 16, and the first bearing 86 are deviated from and parallel to the boss 73, the second shaft hole 17, and the second bearing 87, when the two scrolls 60, 70 rotate in a same direction, the wraps 62, 72 of the two scrolls 60, 70 orbit relative to each other.

As described above, in the co-rotating scroll compressor, although the rotary shafts of the two scrolls are positioned to be deviated from each other, the rotary shafts of the scrolls are located at geometrical centers of shapes of the corresponding end plates of the scrolls from a viewpoint of each of the scrolls. Accordingly, as each of the scrolls does not have eccentricity relative to the rotary shaft, a centrifugal force or vibrations large enough to cause a problem during operation of the compressor are not generated even when the scrolls rotate at a high speed.

In this embodiment, the bosses 63 and 73 are rotatably supported by the bearing, but another structure, for example, a bushing, may also be applied to the co-rotating scroll compressor. That is, a mechanical component configured to reduce friction loss may be applied between the shaft holes of the frame and the rotary shafts (bosses) of the scrolls.

The drive sources may be located above the suction chamber 20. As illustrated in the drawing, a rotor 42 may be installed at an outer circumferential portion of a drive rotary shaft 50, and the rotor 42 may be surrounded by a stator 41 in an annular shape which has a same center as the rotor 42 and is spaced apart from the rotor 42. In addition, a rotational force transmitting portion 53 may be formed at a first end portion or end 51, which is a lower end portion or end, of the drive rotary shaft 50 and be coupled to a rotational force transmitted portion 65 formed at a front end portion or end of the boss 63 of the first scroll 60, which is the drive scroll, to transmit the rotational force. That is, the drive rotary shaft 50 and the boss 63 of the drive scroll may be coupled to restrict each other in a rotational direction but not to restrict each other in a direction of the shafts thereof.

The rotational force transmitting portion 53 and the rotational force transmitted portion 65 has a structure in which a rotational force whose center of rotation is a central shaft of the drive rotary shaft 50 is transmitted while an upsetting moment applied to the first scroll 60 due to a compression repulsive force, for example, of a fluid is not transmitted. Accordingly, the drive rotary shaft 50 may be smoothly rotated by the stator 41 and the rotor 42 without being influenced by the upsetting moment applied to the first scroll 60.

A rotational force of the first scroll may be transmitted to the second scroll by an Oldham ring or another rotation prevention power transmission structure. That is, the rotation prevention power transmission structure is a mechanical structure in which the first scroll and the second scroll rotate in the same direction at a same speed to prevent the second scroll from rotating relative to the first scroll while the rotational force of the first scroll is transmitted to the second scroll.

According to a theoretical working principle of the co-rotating scroll compressor, when the wraps 62 and 72 of the first scroll 60 and the second scroll 70 rotate while facing and being in contact with each other, the rotational force of the first scroll 60 is transmitted to the second scroll 70 through the wraps 62, 72. However, as the rotational force tends not to be easily transmitted due to a compression repulsive force, for example, generated by a fluid in compression chambers formed by the two wraps 62, 72, the above described Oldham ring or other rotation prevention power transmission structure may be applied to the co-rotating scroll compressor.

As described above, the central axes of the two bosses 63 and 73 are parallel but are slightly deviated from each other. Accordingly, when the drive rotary shaft 50 transmits a rotational force to the first scroll 60 while rotating, the first scroll 60 transmits the rotational force to the second scroll 70 though the Oldham ring or the other rotation prevention power transmission structure.

The first scroll 60 and the second scroll 70 rotate in the same direction, and a portion at which the wraps 62 and 72 of the first scroll 60 and the second scroll 70 are in contact with each other decrease areas of compression chambers configured to confine and compress a fluid and move toward the center of the scrolls according to the rotation of the two scrolls. In addition, the compressed fluid is discharged to an outside of the suction chamber 20 through a discharge port 64 formed at a center of the end plate 61. That is, the fluid introduced through the suction port 21 is confined by the compression chamber formed by the wraps of the two scrolls 60 and 70, is compressed while moving toward the center of the two scrolls, and is discharged through the discharge port 64.

The discharge port 64 may extend to the boss 63 of the first scroll 60 and communicate with a hollow portion 55 of the drive rotary shaft 50. In addition, an upper end portion or end of the drive rotary shaft 50 may communicate with a discharge chamber 30 formed at an upper portion of the compressor. Accordingly, the compressed fluid discharged through the discharge port 64 by a predetermined back pressure may be moved upward through the hollow portion 55, discharged to the discharge chamber 30 formed at the upper portion of the compressor 1, and discharged to an outside of the compressor through a discharge port 31 through which the discharge chamber 30 communicates with the outside.

As the discharge chamber 30 is not completely sealed in the compressor and the first end of the drive rotary shaft 50 and the front end of the boss 63 are not also completely sealed, a back pressure of the fluid discharged to the discharge chamber may also be applied to other spaces in the compressor other than the suction chamber 20. In consideration of this, pressure seals 81 and 82 configured to prevent movement of the fluid due to a pressure difference between the suction chamber 20 and the outside of the suction chamber 20 and to maintain the pressure difference between an inside of the suction chamber 20 and an outside of the suction chamber 20 may be provided between the end plate 61 of the first scroll 60 and an inner wall surface of the suction chamber 20 facing the end plate 61. In addition, a thrust bearing 88 configured to support the first scroll 60 against a force applied in a direction of a rotational axis when the first scroll 60 rotates may be formed between a rear surface of the end plate 61 of the first scroll 60 and the inner wall surface of the suction chamber 20.

As described above, a back pressure of a compressed fluid discharged through the discharge port 64 may also be applied to other spaces in the compressor other than the suction chamber 20. In this embodiment, a structure in which the first scroll 60 and the second scroll 70 are pressed against each other by the back pressure being used may be formed.

First, in this embodiment, the first pressure seal 81 may be installed between a rear surface of the end plate 61 of the first scroll 60 and an inner wall of the suction chamber 20. A pressure difference exists between inner and outer portions of the suction chamber 20 due to the first pressure seal 81. The back pressure may be applied to a center of the rear surface of the end plate 61 of the first scroll 60 through the first shaft hole 16, which may be located on or at a side of the frame 10 facing the center of the rear surface of the end plate 61 of the first scroll 60 and accommodate the boss 63. Accordingly, a force corresponding to a product of the pressure difference between the inner and outer portions of the suction chamber 20 and an area defined by the first pressure seal 81 formed on the rear surface of the end plate 61 of the first scroll 60 pushes the first scroll 60 toward the second scroll 70.

Similarly, in this embodiment, the second pressure seal 82 may be installed between a rear surface of the end plate 71 of the second scroll 70 and the inner wall of the suction chamber 20. A pressure difference exists between the inner and outer portions of the suction chamber 20 due to the second pressure seal 82. The back pressure may be applied to the rear surface of the end plate 71 of the second scroll 70 through the second shaft hole 17, which may be located on or at a side of the frame 10 facing a center of the rear surface of the end plate 71 of the second scroll 70 and accommodate the boss 73. Accordingly, a force corresponding to a product of the pressure difference between the inner and outer portions of the suction chamber 20 and an area defined by the second pressure seal 82 formed on the rear surface of the end plate 71 of the second scroll 70 pushes the second scroll 70 toward the first scroll 60.

As the two scrolls are pushed in directions to be moved toward each other by the back pressures which press the two wraps 62, 72 against each other, the surface of the end plate 61 of the first scroll 60 and the front end of the wrap 72 of the second scroll 70 may be firmly pressed against each other and the surface of the end plate 71 of the second scroll 70 and the front end of the wrap 62 of the first scroll 60 may be firmly pressed against each other, and thus, leakage of a fluid compressed by the wraps 62, 72 may be prevented.

According to this embodiment, as the pressure seals 81, 82 are installed between rear surfaces of the two scrolls 60, 70 and the inner surfaces of the suction chamber 20, the pressure difference between the inner and outer portions of the suction chamber 20 may be maintained. In addition, as the rear surfaces of the end plates 61, 71 of the two scrolls 60, 70 defined by the pressure seals 81, 82 are exposed to the back pressures, a compressing force between the two scrolls 60, 70 may be simply and reliably secured.

Figure 2:
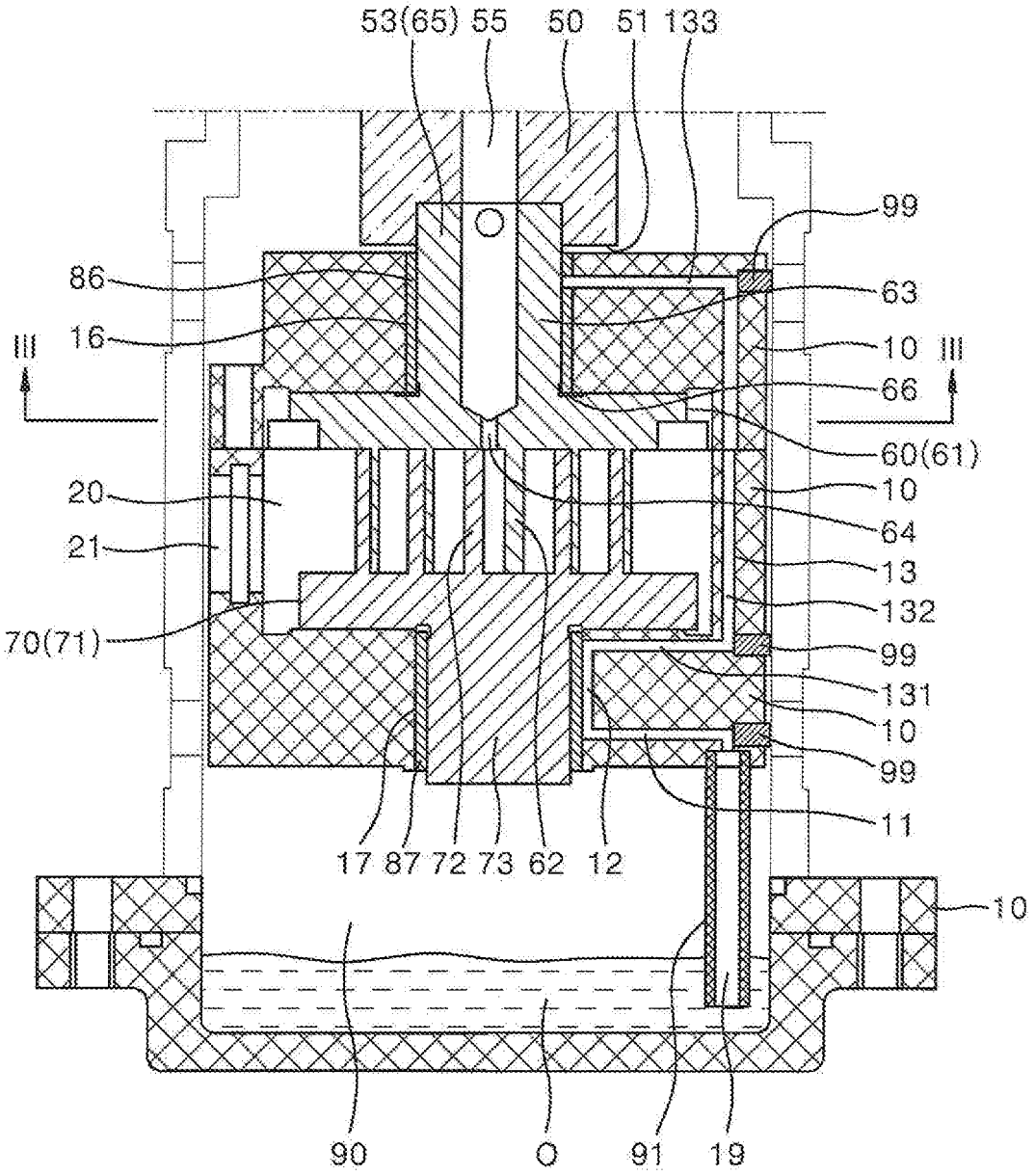
FIG. 2 is a cross-sectional view illustrating an oil supply structure of the co-rotating scroll compressor according to an embodiment.
Figure 3:
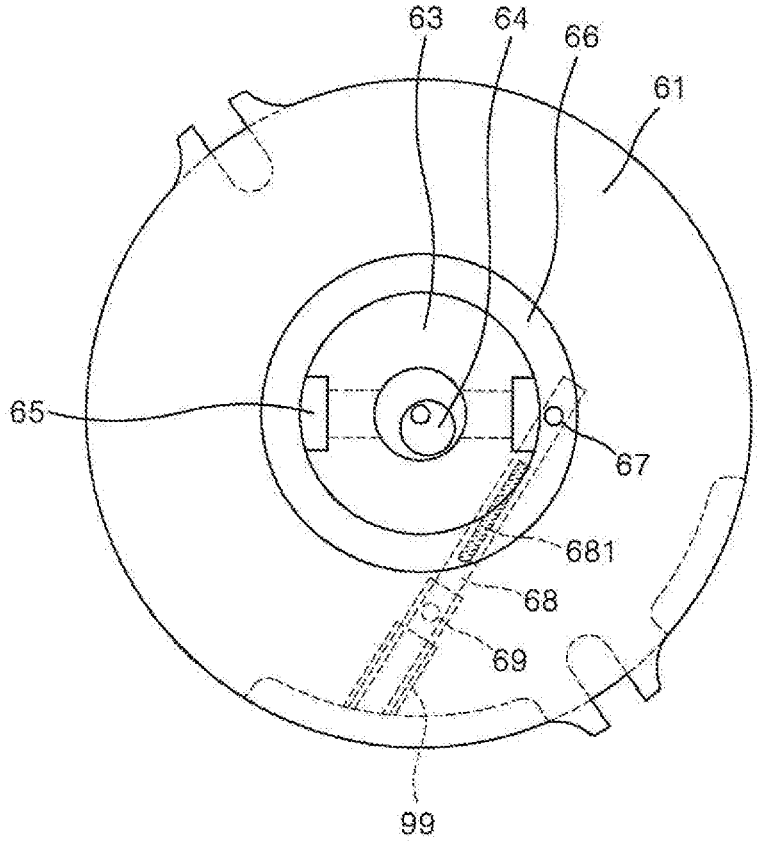
FIG. 3 is a plan perspective view illustrating a drive scroll for describing the oil supply structure according to an embodiment.

FIG. 2 is a cross-sectional view illustrating an oil supply structure of the co-rotating scroll compressor according to an embodiment. FIG. 3 is a plan perspective view illustrating a drive scroll for describing the oil supply structure according to an embodiment.

Referring to FIGS. 1 to 3, an oil storage chamber 90 may be formed at a lower portion of an inner space of the compressor 1. When the oil storage chamber 90 is disposed under components inside of the compressor 1 which need to be lubricated as described above, it is advantageous for collecting oil O which lubricates the inner components and flows downward due to gravity. In other words, this does not necessarily mean that a position of the oil storage chamber 90 disposed in the compressor 1 is a lower end portion of the compressor, but rather, may mean that the position of the oil storage chamber 90 disposed in the compressor 1 is at least under the components to which the oil should be supplied for lubrication.

The first scroll 60 and the second scroll 70, which need to be supplied with the oil, may be disposed above the oil storage chamber 90. The second scroll 70, which is the driven scroll of the two scrolls 60, 70, may be disposed under the first scroll 60 in the compressor 1. The oil storage chamber 90 may be disposed under the driven scroll adjacent thereto. When the oil storage chamber 90 is disposed under the second scroll 70 as described above, as a clearance formed next to the boss 73 of the second scroll 70 may be used as a space for storing the oil, the compressor may be more compact.

The drive rotary shaft 50 for the first scroll 60, which is the drive scroll, may be disposed at a side of the boss 63. When the first scroll 60 is disposed under the second scroll 70, as an oil supply path in the co-rotating scroll compressor in which the oil should be supplied to both the first scroll 60 and the second scroll 70 should pass through a drive portion, the oil supply path must be longer. However, as illustrated in the drawings, when the second scroll 70 is disposed under the first scroll 60, the oil supply path may be correspondingly short.

In addition, in the structure in which the first scroll 60 is located above the second scroll 70, when a discharge path of a fluid compressed by the scroll is disposed above the first scroll 60 as described above, as a chance of the fluid meeting a lubricant oil correspondingly decreases, an amount or ratio of oil mixed to compressed fluid may further decrease. In addition, as a lubricant supply path of the oil and the discharge path of the compressed fluid do not overlap, a flow path of the oil and the discharge path of the compressed fluid may be correspondingly more simply designed.

As described above, a back pressure of a compressed fluid discharged through the discharge port 64 may also be applied to the other spaces in the compressor other than the suction chamber 20. That is, in this embodiment, a structure configured to press the first scroll 60 and the second scroll 70 against each other using such a back pressure may be formed, and the oil also easily supplied to places which require lubrication using the back pressure.

According to this embodiment, flow paths 11, 12, and 13 for supplying the oil to places which require the oil are formed in the frame 10. An insertion groove of an injection pipe 91 in communication with the flow paths may be formed at a lower end portion or end of the frame 10, which is a lower surface thereof facing the oil storage chamber 90. In addition, an upper end portion or end of the injection pipe 91 may be inserted into the insertion groove.

The lower end of the injection pipe 91 may be submerged in the oil stored in the oil storage chamber 90. As the lower end of the injection pipe 91 is in the oil, the oil may be injected through a front end portion or end of an injection path 19 formed in a longitudinal direction of the injection pipe 91. As a back pressure of a discharged compression fluid presses the oil in the oil storage chamber 90, the oil flows along the flow path in the frame 10 through the injection path 19.

The flow path in communication with the injection path 19 may include first flow path 11 which may extend toward an inner circumferential surface of the second shaft hole 17 in the frame 10. Accordingly, oil introduced through the injection path 19 may flow through the first flow path 11 and be supplied to the second bearing 87 installed on the inner circumferential surface of the second shaft hole 17 to lubricate the second bearing 87.

A second flow path 12, which may be connected to a front end portion or end of the first flow path 11 to communicate with the first flow path 11 and has a groove shape, may extend vertically along the inner circumferential surface of the second shaft hole 17. In addition, an upper end of the second flow path 12 may be connected to a third flow path 13 to supply the oil to the first shaft hole 16. The second flow path 12 in the groove shape may serve as a flow path configured to guide a portion of the oil supplied to the inner circumferential surface of the second shaft hole 17 to lubricate the second bearing 87 and guide the remaining oil to flow toward the first shaft hole 16. As described above, the first flow path 11 and the third flow path 13 may communicate with each other through the groove-shaped second flow path 12 formed in the inner circumferential surface of the second shaft hole 17.

The third flow path 13, through which the second shaft hole 17 communicates with the first shaft hole 16, may include a first horizontal path 131 which extends substantially horizontally outward from the second shaft hole 17, a vertical path 132 which extends vertically from an outer end portion or end of the first horizontal path 131 and passes through a portion located at a side surface of the suction chamber 20 in the frame 10, and a second horizontal path 133 which extends substantially horizontally from an upper end portion or end of the vertical path 132 toward an inner circumferential surface of the first shaft hole 16.

As described above, the frame 10 may be assembled through a method in which a plurality of portions are separately manufactured and the separated portions are directly or indirectly fixed to each other for the sake of convenience in manufacture and assembly. In this embodiment, the frame 10 may be separately manufactured as two portions, that is, a first portion in which the first shaft hole 16 is formed, and a second portion including a portion in which the second shaft hole 17 is formed and a side portion of the suction chamber 20, stacked, and assembled for the sake of convenience in manufacture and assembly.

A portion into which the injection pipe 91 is inserted in the second portion of the frame 10 may be formed by upwardly drilling a lower surface of the frame 10. In addition, the first flow path 11 and the first horizontal path 131 may be formed by horizontally inwardly drilling an outer circumferential surface of the second portion of the frame and closing and sealing an outer end portion or end thereof by finishing bolts 99. The vertical path 132 may be formed by downwardly drilling an upper surface of the second portion of the frame 10, upwardly drilling a lower surface of the first portion of the first portion of the frame 10, and the first portion and the second portion of the frame 10 may be stacked in a state in which the first portion and the second portion are in communication with each other. In addition, the second horizontal path 133 may be formed by horizontally inwardly drilling an outer circumferential surface of the first portion of the frame 10 and closing and sealing an outer end portion or end thereof by the finishing bolt 99.

According to such a flow path structure, the oil introduced through the injection path 19 may be supplied to the second bearing 87 through the first flow path 11 and the second flow path 12 and supplied to the first bearing 86 through the third flow path 13. In addition, the oil supplied to the first bearing 86 may flow downward along the inner circumferential surface of the first shaft hole 16 due to gravity and falls around the boss 63 on the end plate 61.

An annular groove 66 configured to accommodate the oil flowing downward along the inner circumferential surface of the first shaft hole 16 may be formed on a circumference of the boss 63, that is, the rear surface of the end plate 61 of the first scroll 60 located under the inner circumferential surface of the first shaft hole 16. In addition, an end plate path 68 may be formed under the annular groove 66 in the end plate 61.

As illustrated in FIG. 3, a portion of a longitudinal length of the end plate path 68 may overlap the annular groove 66 when viewed from above. In addition, as illustrated in FIG. 1, the end plate path 68 and the annular groove 66 may be formed at different heights when viewed from the side. Such an end plate path 68 may be manufactured by inwardly drilling an outer surface of the end plate and closing and sealing an outer end portion or end by the finishing bolt 99.

An inlet hole 67, by which a lower portion of the annular groove 66 and the end plate path 68 may communicate, may be formed in a portion in which the end plate path 68 and the annular groove 66 overlap (see FIG. 3). Accordingly, oil in the annular groove 66 may be introduced into the end plate path 68 through the inlet hole 67.

One or more outlet holes 69 may be formed at predetermined locations in the end plate path 68. The outlet holes 69 may have a hole shape which passes from a lower portion of the end plate path 68 to a front surface of the end plate 61, that is, a bottom surface in FIG. 1. As the suction chamber 20 into which the oil is introduced through the outlet holes 69 has a pressure difference from a back pressure, it is necessary to decompress a hydraulic pressure of the oil before the oil is introduced into the suction chamber 20. Accordingly, in this embodiment, decompression is performed by inserting a decompression pin 681 having a diameter less than the end plate path 68 into the end plate path 68 to induce a loss of pressure in the oil. However, various different decompression methods other than the above described method may be applied to the co-rotating scroll compressor.

In addition, a length of the end plate path 68 should be sufficient to perform adequate decompression. Accordingly, the end plate path 68 may be formed in a direction deviated from the center of the end plate 61 in this embodiment. This secures the sufficient length of the end plate path when compared to the end plate path being formed in a radial direction.

Oil decompressed and supplied to the wrap portions between the two scrolls sufficiently lubricates a close contact portion between the wraps 62, 72 and is supplied downward through an oil groove (not shown), for example, formed in the end plate 71 of the second scroll 70. In addition, the oil flowing downward through the second scroll 70 is collected in the oil storage chamber 90 through the second shaft hole 17, for example.

Figure 4:
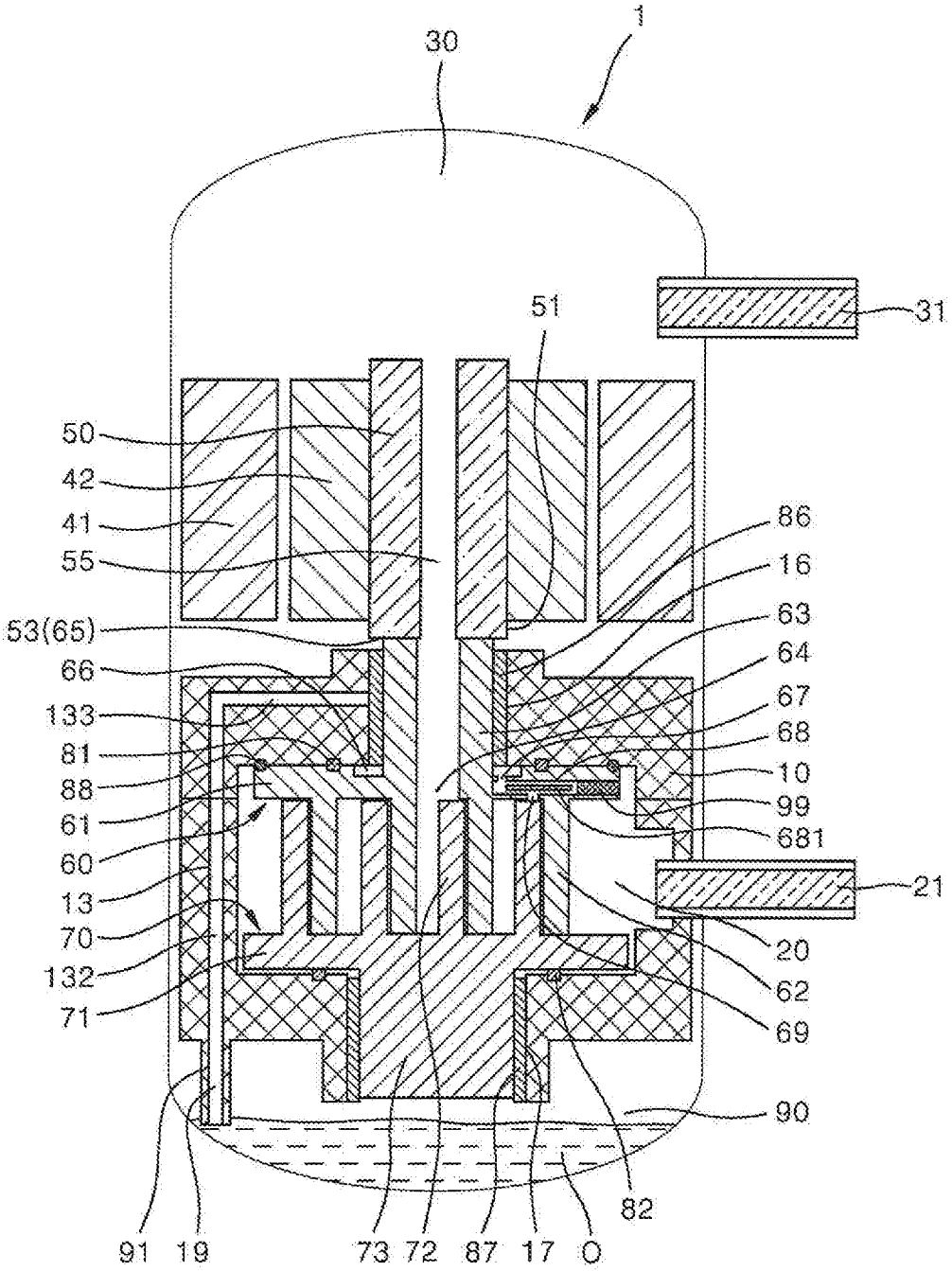
FIGS. 4 and 5 are schematic cross-sectional views of co-rotating scroll compressors having different flow paths according to other embodiments.

According to embodiments, the oil supplied to the first shaft hole 16 may eventually flow downward through the second shaft hole 17. That is, although the oil may not be directly supplied to the second shaft hole 17 through the first flow path 11, the oil may be supplied to the second shaft hole 17. Accordingly, as illustrated in FIG. 4, a structure of a flow path may be further simplified by omitting the first flow path 11, the second flow path 12, and the first horizontal path 131 and directly connecting the vertical path 132 to the injection path 19 such that the vertical path 132 communicates with the injection path 19. However, flow path structures illustrated in FIGS. 1 and 2 may be more suitable for easily supplying the oil to all locations which need to be lubricated at an initial stage operation of the compressor.

Figure 5:
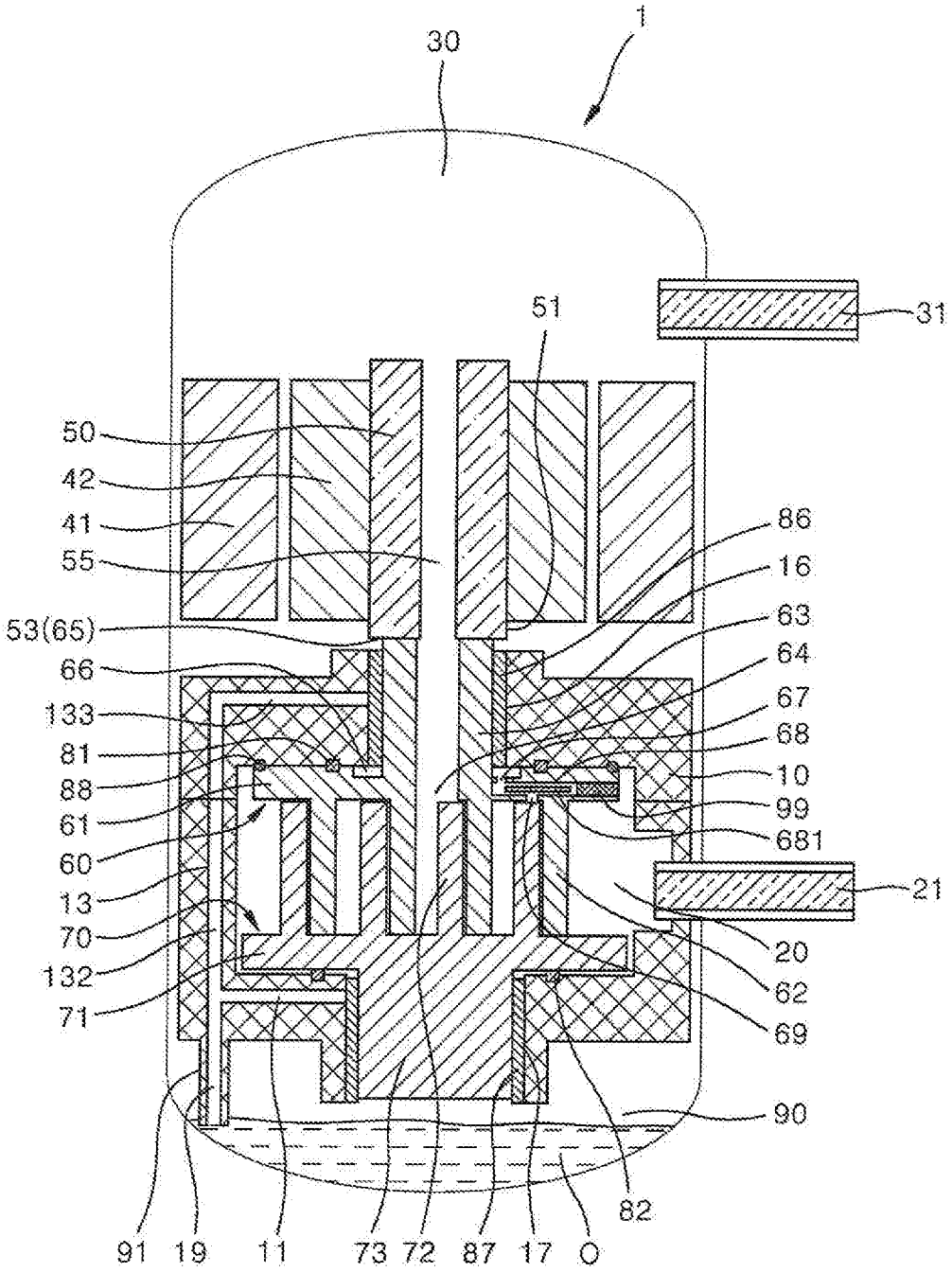

The second flow path 12 and the first horizontal path 131 may be omitted from the flow path structure illustrated in FIG. 1, the vertical path 132 and the injection path 19 may be directly connected to communicate with each other, as illustrated in FIG. 5, and the first flow path 11 may be separated from the injection path 19 to supply the oil to the second bearing 87 and quickly supply the oil to all locations which need to be lubricated at an initial stage of operation. According to such a flow path structure, as a length of the flow path for supplying the oil to the first bearing 86 decreases, the oil may be more quickly supplied to the first bearing 86 at the initial stage operation when compared to the flow path structure illustrated in FIG. 1.

Hereinafter, an operation of the co-rotating scroll compressor will be described.

First, when a rotational force is generated at the drive rotary shaft 50 by the stator 41 and the rotor 42, the rotational force of the drive rotary shaft 50 may be supplied to the first scroll 60 by the rotational force transmitting portion 53 of the first end portion 51 and the rotational force transmitted portion 67 formed in the boss 63. The first scroll 60 may also transmit the rotational force to the second scroll 70 while receiving the rotational force and rotating. A path through which the rotational force of the drive scroll is transmitted to the driven scroll as described above may have wraps of two scrolls in contact with each other and a rotation prevention power transmission structure having Oldham rings, or pins and rings (or holes) corresponding thereto.

The first scroll 60 may rotate about a center of rotation of the drive rotary shaft 50, and the second scroll 70 may rotate about a center of rotation of the boss 73. Although the centers of rotation of the two scrolls are not the same and are eccentrically disposed, the two scrolls rotate without eccentricity relative to the corresponding centers of rotation.

A fluid introduced into the suction chamber 20 through the suction port 21 may be compressed while being surrounded by compression chambers formed by the wraps of the two scrolls and moved toward a central portion thereof. The compressed fluid may be discharged from the center of the two scrolls to the discharge chamber 30 through the discharge port 64 of the first scroll 60 and the hollow portion 55 in communication with the discharge port 64.

Although the discharged fluid may be discharged to an outside of the compressor through the discharge port 31, a back pressure of the compressed fluid discharged from the suction chamber 20 may be applied to other inner portions in the compressor other than an inner portion of the suction chamber 20. Back pressures and a pressure difference inside the suction chamber 20 may be maintained by the pressure seals 81 and 82 formed between rear surfaces of end plates 61, 71 of the first scroll 60 and the second scroll 70 and an inner wall of the suction chamber 20.

The back pressures press the rear surfaces of the end plates 61, 71 of the first scroll 60 and the second scroll 70. Accordingly, the wraps 62, 72 of the first scroll 60 and the second scroll 70 are pressed against each other or against surfaces of the end plates 61, 71 in contact with the wraps 62, 72 to prevent pressure leakage of the fluid compressed by the two scrolls 60, 70.

In addition, the back pressures press oil for lubrication. Then, oil stored in the oil storage chamber 90 may be supplied to the first bearing 86 and the second bearing 87 and supplied between the end plates 61, 71 of the two scrolls 60, 70, for example, which need to be lubricated, along the injection pipe 91 via a flow path of the frame 10. The oil supplied to the first bearing may be supplied between the end plates 61, 71 of the two scrolls 60, 70 through the first scroll 60, supplied to the second bearing 87 through the second scroll 70, for example, and collected in the oil storage chamber 90. The path through which the oil is supplied to the first bearing 86 and the second bearing 87 may be understood as being the flow path structures in FIGS. 1,4, and 5.

According to embodiments, back pressures of a compressor may be used as pressing sources configured to press two scrolls against each other and as supply sources configured to supply oil. In addition, a structure configured to press two scrolls against each other and to supply oil using a back pressure of a compressor may be simplified. Further, a structure of a compressor may be formed to be more compact. Furthermore, a compressor may be more easily manufactured and assembled.

Embodiments disclosed herein are directed to a compressor structure in which two scrolls of co-rotating scrolls are pressed against each other in a simple structure, rotation supports of a drive scroll and a driven scroll are lubricated in the simple structure, and a close contact portion between the two scrolls is lubricated. In addition, embodiments disclosed herein are directed to a co-rotating scroll compressor having a structure in which a close contact and lubrication structure of two scrolls are simply formed.

Further, embodiments disclosed herein are directed to a co-rotating scroll compressor having a structure which is simple to be easily manufactured and assembled. Furthermore, embodiments disclosed herein are directed to a co-rotating scroll compressor formed with a simple structure in which a back pressure structure configured to move oil for lubricating two scrolls serves as a force which presses the two scrolls against each other.

Embodiments disclosed herein provide a co-rotating scroll compressor that may include pressure seals between rear surfaces of end plates of a drive scroll and a driven scroll and an inner wall of a suction chamber such that two scrolls may be pressed in directions to be moved toward each other by back pressures, and oil may be supplied to rotation supports and close contact portions of the two scrolls using the back pressures. More specifically, according to embodiments disclosed herein, there is provided a co-rotating scroll compressor that may include a frame including a suction chamber provided with a suction port; a first scroll and a second scroll having wraps disposed to face each other in the suction chamber and rotary shafts which are eccentric relative to each other, the first scroll and the second scroll rotating relative to each other in a same direction, compressing a fluid suctioned into the suction chamber, and discharging the compressed fluid to an outside of the suction chamber, a first compression seal formed between a rear surface of an end plate of the first scroll and an inner wall of the suction chamber; and a second pressure seal formed between a rear surface of an end plate of the second scroll and the inner wall of the suction chamber. A pressure of the fluid discharged by the first scroll and the second scroll do not leak to a pressure of the fluid in the suction chamber due to the pressure seal, and the discharge pressure may be applied to the end plates to press the first scroll and the second scroll in directions in which the first scroll and the second scroll are moved toward each other. According to such a structure, back pressures may be applied to both of the rear surfaces of the two scrolls such that the two scrolls may be pressed in directions to be moved toward each other.

A first shaft hole configured to accommodate the rotary shaft of the first scroll may be formed in a portion of the frame facing a center of the rear surface of the end plate of the first scroll. A space of the rear surface of the end plate of the first scroll to which the discharge pressure is applied may communicate with the first shaft hole, and thus, the back pressure may be applied to the rear surface of the end plate of the first scroll. A second shaft hole configured to accommodate the rotary shaft of the second scroll may be formed in a portion of the frame facing a center of the rear surface of the end plate of the second scroll. A space of the rear surface of the end plate of the second scroll to which the discharge pressure is applied may communicate with the second shaft hole, and thus, the back pressure may also be applied to the rear surface of the end plate of the second scroll. As described above, when the back pressures are applied to both of the rear surfaces of the end plates of the two scrolls, a contact force between the two scrolls may be maintained using a simpler structure.

In addition, an oil storage chamber may be formed at a lower end portion or end of the frame, the discharge pressure may be applied to a surface of oil stored in the oil storage chamber, and a front end portion or end of an injection path through which the oil pressed by the discharge pressure may be injected, may be submerged in the oil in the oil storage chamber. Accordingly, the discharge pressure, that is, the back pressure, becomes a drive force source which pushes the oil into the injection path. In addition, as the oil storage chamber may be located at the lower end portion of the frame, oil flowing downward due to gravity may be easily collected.

When the second scroll is a driven scroll and the second scroll is disposed to be closer to the lower end portion of the frame than the first scroll, as a relatively free space around a boss of the driven scroll may be utilized as the oil storage chamber, the compressor may be more simply formed. In addition, as the drive rotary shaft may be disposed on a side of the drive scroll located above the driven scroll, a length of the flow path through which the oil may be supplied from the oil storage chamber toward the drive scroll may be reduced, and thus, the flow path may be more simply formed.

When a discharge port is formed in a center of the end plate of the first scroll and the discharge port communicates with a hollow portion formed in a longitudinal direction of the rotary shaft of the first scroll, as a path through which a fluid compressed in and discharged from the suction chamber and a path of the oil may be disposed at different positions, a structure of the compressor may be further simplified. In addition, as contact between the oil and the compressed fluid may be reduced, a ratio of the oil mixed with the compressed fluid may also be further decreased.

In addition, the flow path may include a flow path portion configured to communicate with an inner circumferential surface of a first shaft hole configured to accommodate the rotary shaft of the first scroll, and a flow path portion configured to communicate with an inner circumferential surface of a second shaft hole configured to accommodate the rotary shaft of the second scroll. An annular groove configured to accommodate oil flowing downward along the inner circumferential surface of the first shaft hole may be formed in the rear surface of the end plate of the first scroll located under the inner circumferential surface of the first shaft hole, an end plate path configured to communicate with an inlet hole formed in a bottom surface of the annular groove may be formed in the end plate, and an outlet hole configured to communicate with the end plate path in a direction of a front surface of the end plate facing the second scroll may be formed at a predetermined position of a bottom surface of the end plate path. According to such a structure, as the oil supplied to a rotary shaft support portion or support of the first scroll may flow downward and be supplied to a space between the end plates of the two scrolls, that is, to a space in which the wraps are pressed against each other, the oil may be supplied to various portions through a simple structure.

According to embodiments disclosed herein, there is also provided a co-rotating scroll compressor that may include a frame including a suction chamber provided with a suction port; and a first scroll and a second scroll including wraps disposed to face each other in the suction chamber and rotary shafts which are eccentric relative to each other, the first scroll and the second scroll rotating relative to each other in a same direction, compressing a fluid suctioned into the suction chamber, and discharging the compressed fluid to an outside of the suction chamber. An oil storage chamber may be formed at a lower end portion or end of the frame, a discharge pressure may be applied to a surface of oil stored in the oil storage chamber, and a front end portion or end of an injection path may be in the oil in the oil storage chamber such that the oil pressed by the discharge pressure may be injected into a flow path formed in the frame. When the injection path includes an injection pipe and the injection pipe is connected to the frame to communicate with a front end portion or end of the flow path formed in the frame, oil supply may be simply assembled and formed.

When the second scroll is disposed to be closer to a lower end portion or end of the frame than the first scroll and the flow path includes a first flow path configured to communicate with an inner circumferential surface of a second shaft hole of the frame configured to accommodate the rotary shaft of the second scroll and when the flow path includes a third flow path through which the inner circumferential surface of the second shaft hole and an inner circumferential surface of a first shaft hole of the frame configured to accommodate the rotary shaft of the first scroll communicate with each other, the oil may be supplied to all of the rotary shaft support portions or supports of the two scrolls which need to be lubricated. When the first flow path and the third flow path communicate with each other through a groove-shaped second flow path formed in the inner circumferential surface of the second shaft hole, oil supplied to the first shaft hole through the second shaft hole may not be excessively supplied to the second shaft hole and may be sufficiently supplied toward the first shaft hole. When the third flow path includes a first horizontal path formed in a portion located under the suction chamber in the frame and having one or a first end portion or end communicating with the inner circumferential surface of the second shaft hole; a second horizontal path formed in a portion located above the suction chamber in the frame and having one or a first end portion or end communicating with the inner circumferential surface of the first shaft hole; and a vertical path which is formed in a portion located next to the suction chamber in the frame, and in which the other or a second end portion or end of the first horizontal path and the other or a second end portion or end of the second horizontal path communicate with each other through the vertical path, an operation to form the flow path in the frame may be simply performed.

The second scroll may be disposed to be closer to the lower end portion of the frame than the first scroll, the flow path may include a third flow path configured to communicate with an inner circumferential surface of a first shaft hole configured to accommodate the rotary shaft of the first scroll, an annular groove configured to accommodate oil flowing downward along the inner circumferential surface of the first shaft hole may be formed in a rear surface of an end plate of the first scroll located under the inner circumferential surface of the first shaft hole, an end plate path configured to communicate with an inlet hole formed in a bottom surface of the annular groove may be formed in the end plate, and an outlet hole configured to communicate with the end plate path in a direction of a front surface of the end plate facing the second scroll may be formed at a predetermined position of a bottom surface of the end plate path. The end plate path may be formed in a direction deviated from a center of the end plate, and when the end plate path is formed to be inclined, a length of the end plate path may be sufficiently secured in comparison to when the end plate path is formed in a radial direction relative to a center of the end plate. Accordingly, when a decompression pin is inserted into such an end plate path, a pressure of the oil may be sufficiently decreased.

A drive rotary shaft configured to transmit a rotational force to the first scroll may be disposed above the first scroll, a discharge port may be formed in a center of the end plate of the first scroll, and the discharge port may communicate with a hollow portion formed in a longitudinal direction of the drive rotary shaft of the first scroll.

The co-rotating scroll compressor may further include a first compression seal formed between a rear surface of the end plate of the first scroll and an inner wall of the suction chamber, and a second pressure seal formed between a rear surface of the end plate of the second scroll and the inner wall of the suction chamber. The pressure of the fluid discharged by the first scroll and the second scroll may not leak to the pressure of the fluid in the suction chamber due to the pressure seals, and the discharge pressure may be applied to the end plates to press the first scroll and the second scroll in directions in which the first scroll and the second scroll are moved toward each other.

As described above, while embodiments have been described with reference to the accompanying drawings, the embodiments are not limited to the embodiments disclosed and drawings illustrated in the present specification, and it should be clear to those skilled in the art that various modifications may be made within a technical sprit. In addition, although effects according to the structure of the embodiments have not been clearly described, predictable effects according to the corresponding structure should also have been naturally recognized.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A co-rotating scroll compressor, comprising:

a frame including a suction chamber provided with a suction port;

a first scroll and a second scroll having wraps disposed to face each other in the suction chamber and rotary shafts which are eccentric relative to each other, wherein the first scroll and the second scroll rotate relative to each other in a same direction, compress a fluid suctioned into the suction chamber, and discharge the compressed fluid to an outside of the suction chamber;

a first pressure seal formed between a rear surface of an end plate of the first scroll and a first inner wall of the suction chamber; and a second pressure seal formed between a rear surface of an end plate of the second scroll and a second inner wall of the suction chamber, wherein the first pressure seal and the second pressure seal prevent a pressure of the fluid discharged by the first scroll and the second scroll from leaking to a pressure of the fluid in the suction chamber, and wherein the discharge pressure is applied to the end plates to press the first scroll and the second scroll in directions in which the first scroll and the second scroll are moved toward each other.

2. The co-rotating scroll compressor of claim 1, wherein a first shaft hole configured to accommodate the rotary shaft of the first scroll is formed in a portion of the frame facing a center of the rear surface of the end plate of the first scroll, and a space at the rear surface of the end plate of the first scroll to which the discharge pressure is applied communicates with the first shaft hole.

3. The co-rotating scroll compressor of claim 2, wherein a second shaft hole configured to accommodate the rotary shaft of the second scroll is formed in a portion of the frame facing a center of the rear surface of the end plate of the second scroll, and a space at the rear surface of the end plate of the second scroll to which the discharge pressure is applied communicates with the second shaft hole.

4. The co-rotating scroll compressor of claim 1, wherein an oil storage chamber is formed at a lower end of the frame, the discharge pressure is applied to a surface of oil stored in the oil storage chamber, and a front end of an injection path, through which the oil pressed by the discharge pressure is injected, is in the oil in the oil storage chamber.

5. The co-rotating scroll compressor of claim 4, wherein the second scroll is driven by the first scroll, and the second scroll is disposed to be closer to the lower end of the frame than the first scroll.

6. The co-rotating scroll compressor of claim 5, wherein a discharge port is formed in a center of the end plate of the first scroll, and the discharge port communicates with a hollow portion formed in a longitudinal direction of the rotary shaft of the first scroll.

7. The co-rotating scroll compressor of claim 4, further comprising a flow path configured to communicate with an inner circumferential surface of a first shaft hole configured to accommodate the rotary shaft of the first scroll to supply oil stored in the oil storage chamber to the inner circumferential surface of the first shaft hole.

8. The co-rotating scroll compressor of claim 7, wherein:

an annular groove configured to accommodate oil flowing downward along the inner circumferential surface of the first shaft hole is formed in the rear surface of the end plate of the first scroll located under the inner circumferential surface of the first shaft hole;

an end plate path configured to communicate with an inlet hole formed in a bottom surface of the annular groove is formed in the end plate; and an outlet hole configured to communicate with the end plate path in a direction of a front surface of the end plate facing the second scroll is formed at a predetermined position of a bottom surface of the end plate path.

9. A co-rotating scroll compressor, comprising:

a frame including a suction chamber provided with a suction port; and a first scroll and a second scroll including wraps disposed to face each other in the suction chamber and rotary shafts which are eccentric relative to each other, wherein the first scroll and the second scroll rotate relative to each other in a same direction, compress a fluid suctioned into the suction chamber, and discharge the compressed fluid to an outside of the suction chamber, wherein:

an oil storage chamber is formed at a lower end of the frame;

the second scroll is disposed to be closer to the lower end of the frame than the first scroll;

a discharge pressure is applied to a surface of oil stored in the oil storage chamber and presses the second scroll toward the first scroll; and a front end of an injection path is in the oil in the oil storage chamber such that the oil pressed by the discharge pressure is injected into a flow path formed in the frame.

10. The co-rotating scroll compressor of claim 9, wherein the injection path includes an injection pipe, and the injection pipe is connected to the frame to communicate with a front end of the flow path formed in the frame.

11. The co-rotating scroll compressor of claim 9, wherein the flow path includes a first flow path configured to communicate with an inner circumferential surface of a first shaft hole of the frame configured to accommodate the rotary shaft of the second scroll.

12. The co-rotating scroll compressor of claim 11, wherein the flow path includes a second flow path through which the inner circumferential surface of the first shaft hole and an inner circumferential surface of a second shaft hole of the frame configured to accommodate the rotary shaft of the first scroll communicate with each other.

13. The co-rotating scroll compressor of claim 12, wherein the second flow path and the first flow path communicate with each other through a groove-shaped third flow path formed in the inner circumferential surface of the first shaft hole.

14. The co-rotating scroll compressor of claim 12, wherein the second flow path includes:

a first horizontal path formed in a portion located under the suction chamber in the frame and having a first end that communicates with the inner circumferential surface of the first shaft hole;

a second horizontal path formed in a portion located above the suction chamber in the frame and having a first end that communicates with the inner circumferential surface of the second shaft hole; and a vertical path which is formed in a portion located next to the suction chamber in the frame, and by which a second end of the first horizontal path and a second end of the second horizontal path communicate with each other.

15. The co-rotating scroll compressor of claim 9, wherein the flow path includes a first flow path configured to communicate with an inner circumferential surface of a first shaft hole configured to accommodate the rotary shaft of the first scroll.

16. The co-rotating scroll compressor of claim 15, wherein:

an annular groove configured to accommodate oil flowing downward along the inner circumferential surface of the first shaft hole is formed in a rear surface of an end plate of the first scroll located under the inner circumferential surface of the first shaft hole;

an end plate path configured to communicate with an inlet hole formed in a bottom surface of the annular groove is formed in the end plate; and an outlet hole configured to communicate with the end plate path in a direction of a front surface of the end plate facing the second scroll is formed at a predetermined position of a bottom surface of the end plate path.

17. The co-rotating scroll compressor of claim 16, wherein the end plate path is formed in a direction deviated from a center of the end plate.

18. The co-rotating scroll compressor of claim 16, wherein a decompression pin is inserted into the end plate path to decrease a pressure of the oil.

19. The co-rotating scroll compressor of claim 15, wherein a drive rotary shaft configured to transmit a rotational force to the first scroll is disposed above the first scroll.

20. The co-rotating scroll compressor of claim 19, wherein a discharge port is formed in a center of an end plate of the first scroll, and the discharge port communicates with a hollow portion formed in a longitudinal direction of the drive rotary shaft.

* * * * *